US009331419B2

(12) United States Patent
Yagi et al.

(10) Patent No.: US 9,331,419 B2
(45) Date of Patent: May 3, 2016

(54) ELECTRIC CONNECTOR

(71) Applicant: DAI-ICHI SEIKO CO., LTD., Kyoto (JP)

(72) Inventors: Sakai Yagi, Shizuoka (JP); Jun Mukunoki, Shizuoka (JP); Daisuke Matsushita, Shizuoka (JP)

(73) Assignee: DAI-ICHI SEIKO CO., LTD (JP)

( * ) Notice: Subject to any disclaimer, the term of this patent is extended or adjusted under 35 U.S.C. 154(b) by 0 days.

(21) Appl. No.: 14/707,473

(22) Filed: May 8, 2015

(65) Prior Publication Data

US 2015/0333433 A1 Nov. 19, 2015

(30) Foreign Application Priority Data

May 19, 2014 (JP) ..... 2014-103561

(51) Int. Cl.
*H01R 13/516* (2006.01)
*H01R 13/514* (2006.01)

(52) U.S. Cl.
CPC ..... *H01R 13/516* (2013.01); *H01R 13/514* (2013.01)

(58) Field of Classification Search
CPC ..... H01R 13/514; H01R 13/516; H01R 13/4362; H01R 13/4361; H01R 13/6275; H01R 13/6272; H01R 13/4223; H01R 13/4365
USPC ..... 439/701, 752, 595, 596, 358
See application file for complete search history.

(56) References Cited

U.S. PATENT DOCUMENTS

| | | | | |
|---|---|---|---|---|
| 5,518,334 | A * | 5/1996 | Yagi | H01R 13/4223 220/839 |
| 5,651,703 | A | 7/1997 | Sasai | 439/752 |
| 9,070,999 | B2 * | 6/2015 | Endo | H01R 13/506 |
| 2006/0166545 | A1 * | 7/2006 | Tanaka | H01R 13/6272 439/358 |
| 2009/0269963 | A1 * | 10/2009 | Brown | H01R 13/4223 439/357 |

FOREIGN PATENT DOCUMENTS

| | | | |
|---|---|---|---|
| JP | H0845596 | 2/1996 | H01R 13/42 |
| JP | 4304502 | 7/2009 | H01R 13/42 |

* cited by examiner

*Primary Examiner* — Edwin A. Leon
(74) *Attorney, Agent, or Firm* — Hayes Soloway P.C.

(57) ABSTRACT

The electric connector including a housing formed with a plurality of holes into each of which a terminal is inserted, the holes being aligned in a line in a first direction, a rear holder connected to the housing through a hinge such that the rear holder is rotatable relative to the housing, a first engagement unit for connecting the rear holder and the housing to each other, the first engagement unit being arranged at at least one of opposite ends in the first direction, and a second engagement unit for preventing the rear holder and the housing from separating from each other after the rear holder and the housing are connected to each other, the second engagement unit being situated between the holes located adjacent to each other.

7 Claims, 11 Drawing Sheets

ELECTRIC CONNECTOR

BACKGROUND OF THE INVENTION

1. Field of the Invention

The present invention relates to an electric connector to be equipped in a wire harness for electrically connecting a circuit board and the wire harness.

2. Description of the Related Art

An example of such an electric connector is disclosed in Japanese Patent Application Publication H08-45596 published on Feb. 16, 1996.

FIG. 13 is a perspective view of an electric connector 50 disclosed in the Publication.

The electric connector 50 includes a connector housing 1 formed with a plurality of terminal holes 3 into each of which a terminal 5 (see FIG. 14) is inserted, and a pair of retainers 7 connected to the connector housing 1 through a pair of elastically deformable hinges 8.

The retainers 7 are arranged above and below the connector housing 1.

FIG. 14 is a partial cross-sectional view showing the terminal 5 inserted into the terminal hole 3.

As illustrated in FIG. 14, the connector housing 1 includes an elastic engagement piece 6 partially protruding into the terminal hole 3. The elastic engagement piece 6 is engaged with the terminal 5 inserted into the terminal hole 3 to thereby firstly prevent the terminal 5 from being pulled out of the terminal hole 3.

Furthermore, the retainers 7 are connected to the connector housing 1 by folding the hinges 8 to cause the retainers 7 to partially enter the terminal holes 3. This secondly prevents the terminal 5 from being pulled out of the terminal hole 3.

FIGS. 15A, 15B and 15C are partial side views showing the engagement of the retainers 7 with the connector housing 1.

As illustrated in FIG. 15A, the connector housing 1 includes at each of sidewalls thereof a recess 16 into which each of sides 15 of the retainer 7 is fit. The retainer 7 is formed at the side 15 thereof with an elongate hole 19. In the recess 16, formed are a first projection 21 and a second projection 22 both fittable into the elongate hole 19.

The retainers 7 are engaged to the connector housing 1 in such a way as mentioned below.

Firstly, as illustrated in FIG. 15A, the side 15 of the retainer 7, which is connected to the connector housing 1 through the hinges 8, is fit into the recess 16 from above.

Then, as illustrated in FIG. 15B, the first projection 21 is fit into the elongate hole 19 at a front end of the elongate hole 19. Thus, the retainer 7 is temporarily engaged to the connector housing 1.

Then, as illustrated in FIG. 15C, the retainer 7 is pushed further into the recess 16. Then, the second projection 22 is fit into the elongate hole 19 at a front end of the elongate hole 19.

Thus, the first and second projections 21 and 22 are fit into the elongate hole 19 at opposite ends of the elongate hole 19, and accordingly, the retainer 7 is completely engaged to the connector housing 1.

As illustrated in FIGS. 13 and 14, each of the retainers 7 includes a pair of outwardly projecting projections 4. As illustrated in FIG. 15C, when the retainers 7 are completely engaged with the connector housing 1, the projections 4 are fit into recesses (not illustrated) formed at the connector housing 1 to thereby prevent the retainers 7 from floating up from the connector housing 1.

The projections 4 are horizontally fit into the recesses (not illustrated) of the connector housing 1. Thus, if the terminal 10 is pulled in a direction opposite to a direction in which the terminal 5 is inserted into the terminal hole 3, it is afraid that the projections 4 and the recesses of the connector housing 1, and, accordingly, the retainers 7 and the connector housing 1 may be disengaged from each other.

Furthermore, the projections 4 are engaged with the recesses of the connector housing 1 above an area in which the terminal holes 3 are arranged in a thickness-wise direction (the direction X in FIGS. 13 and 14) of the connector housing 1. Therefore, it is impossible to design the electric connector 50 to be low in height. Thus, recent designing needs for an electric connector to be low in height cannot be satisfied.

SUMMARY OF THE INVENTION

In view of the above-mentioned problems in the conventional electric connector, it is an object of the present invention to provide an electric connector capable of preventing a retainer from separating from a connector housing, and further, not preventing an electric connector from being low in height.

In one aspect of the present invention, there is provided an electric connector including a housing formed with a plurality of holes into each of which a terminal is inserted, the holes being aligned in a line in a first direction, a rear holder connected to the housing through a hinge such that the rear holder is rotatable relative to the housing, a first engagement unit for connecting the rear holder and the housing to each other, the first engagement unit being arranged at at least one of opposite ends in the first direction, and a second engagement unit for preventing the rear holder and the housing from separating from each other after the rear holder and the housing are connected to each other, the second engagement unit being situated between the holes located adjacent to each other.

When the rear holder is rotated around the hinge onto the housing after a terminal is inserted into a hole, the first engagement unit(s) connects the rear holder and the housing to each other. Thus, the electric connector can be readily assembled.

Furthermore, since the rear holder and the housing are engaged to each other through the first engagement unit(s), and further through the second engagement unit situated between adjacent holes, it is possible to prevent the rear holder from being released from the housing.

Furthermore, since the first engagement unit(s) and the second engagement unit are designed to be aligned in the first direction, it is possible to avoid that an area in which the holes are arranged and the first and second engagement units are situated in a multi-layered condition, ensuring that the electric connector is not prevented from being designed to be low in height.

It is preferable that the second engagement unit be formed at the housing at a center in the first direction.

It is preferable that the terminal include a hollow contact section into which a second terminal can be inserted, and a cable-fixing section to which a cable is fixed, the cable-fixing section being continuous to a proximal end of the contact section, the second engagement unit being formed in an area in which cable-fixing sections of the terminals inserted into the holes are situated.

It is preferable that the second engagement unit include a first engagement section formed at the housing, and a second engagement section formed at the rear holder, the first engagement section including a first inclining surface sloping upward in a second direction opposite to a direction in which the terminal is inserted into each of the holes, the second engagement section including a tip end making point-contact or line-contact with the first inclining surface when a tensile force acts on the rear holder in the second direction.

It is preferable that the first engagement section further include a second inclining surface sloping downward in the second direction, the first inclining surface and the second inclining surface being continuous with each other.

It is preferable that the second engagement section include a third inclining surface sloping upward in the second direction, and a fourth inclining surface sloping downward in the second direction, the tip end being defined as a point at which the third and fourth inclining surfaces make contact with each other.

It is preferable that an angle at which the third inclining surface inclines relative to a vertical direction be greater than an angle by which the first inclining surface inclines relative to a vertical direction.

It is preferable that an angle at which the first inclining surface inclines relative to a vertical direction be in the range of 10 degrees to 45 degrees both inclusive.

The advantages obtained by the aforementioned present invention will be described hereinbelow.

The electric connector in accordance with the present invention prevents the rear holder from being released from the housing by means of the second engagement unit, and does not prevent from being designed to be low in height.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

An electric connector 100 in accordance with a preferred embodiment of the present invention will be explained hereinbelow with reference to FIGS. 1 to 12.

Figure 1:
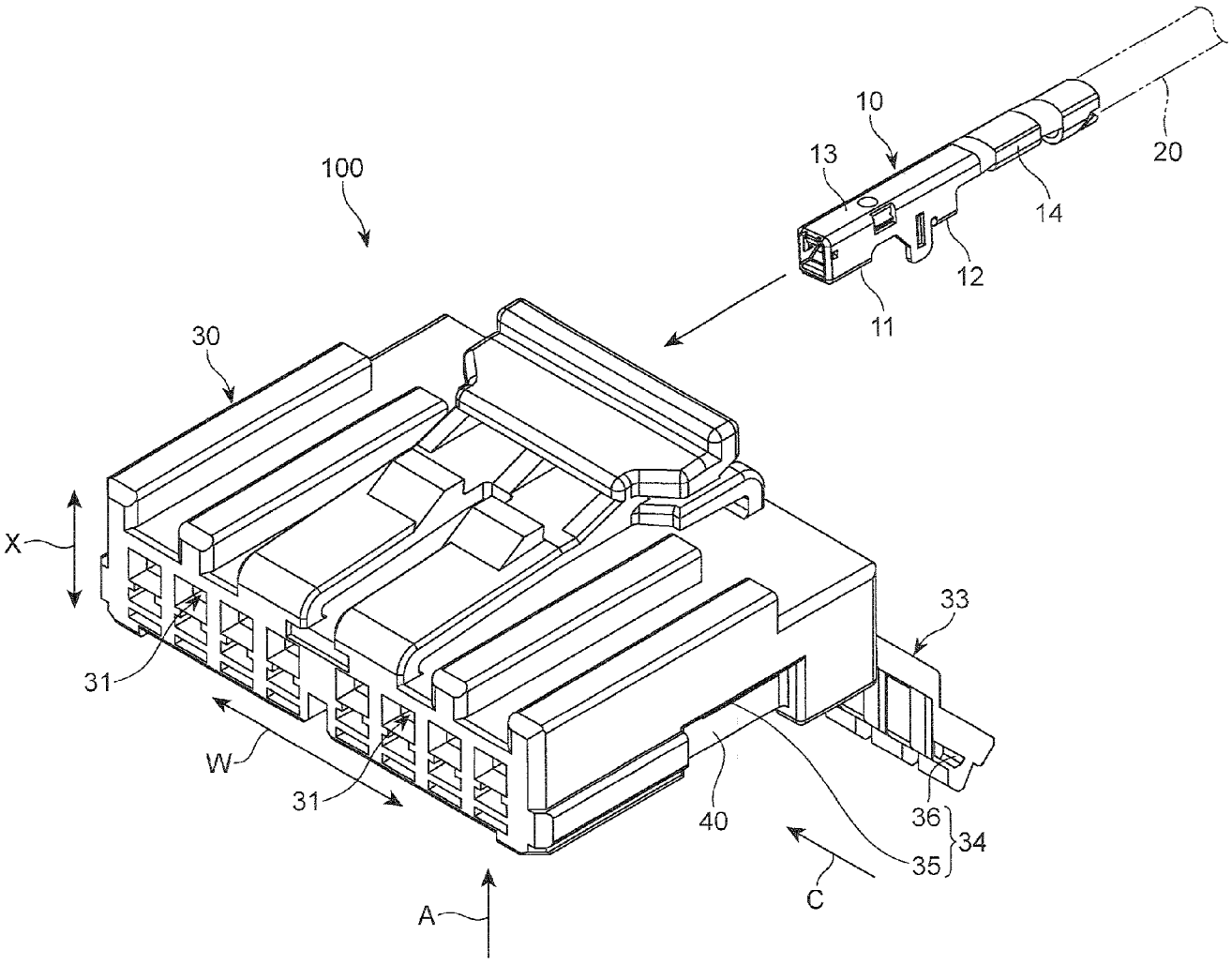
FIG. 1 is a perspective view of an electric connector in accordance with a preferred embodiment of the present invention.
Figure 2:
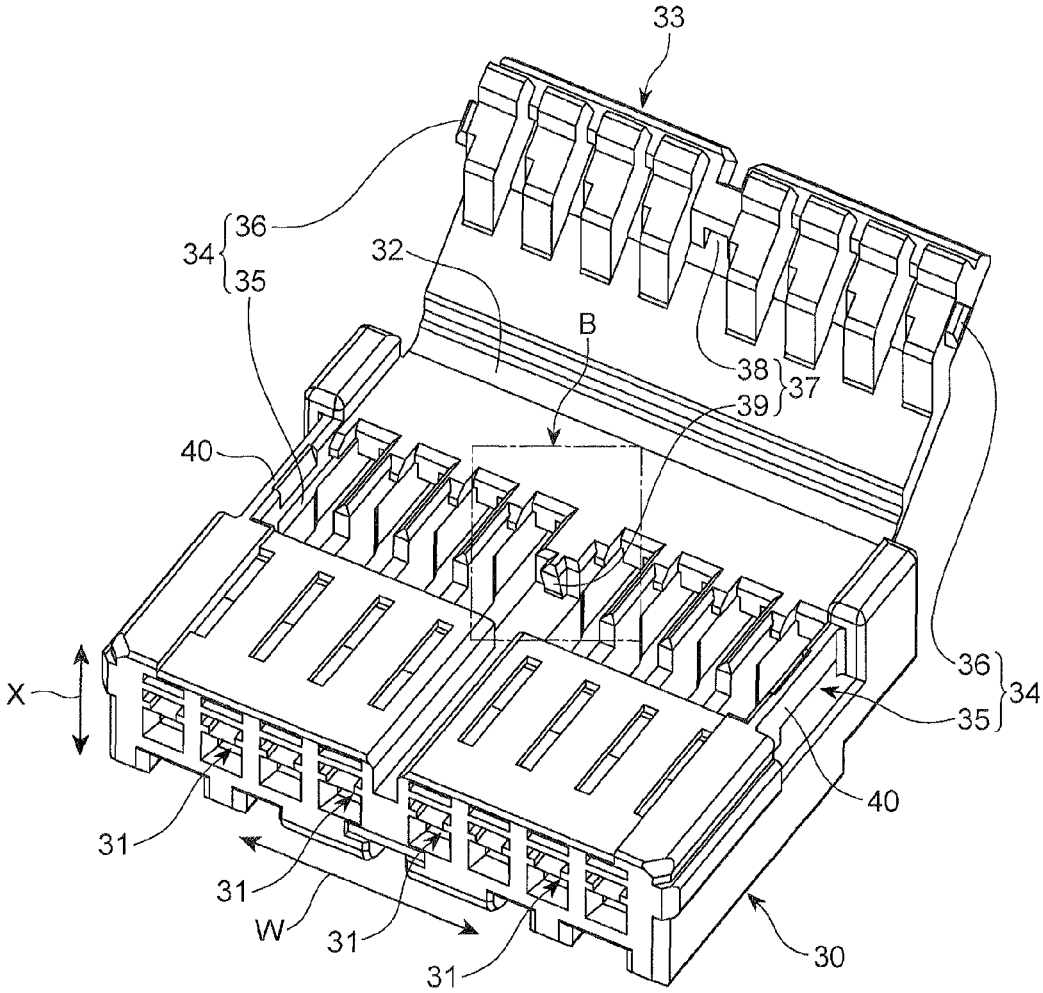
FIG. 2 is a perspective view of the electric connector, viewed in a direction of the arrow A shown in FIG. 1.
Figure 3:
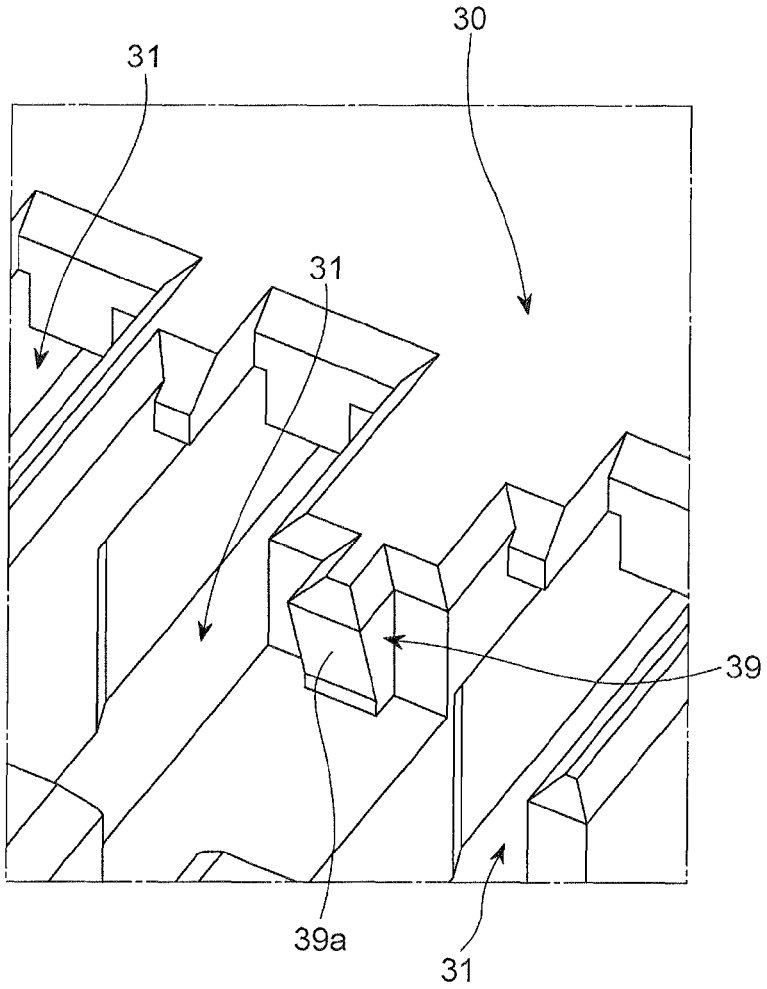
FIG. 3 is an enlarged view of the portion B shown with the arrow B in FIG. 2.

As illustrated in FIGS. 1 and 2, the electric connector 100 includes a housing 30 formed with a plurality of holes 31 into each of which a terminal 10 is inserted, the holes 10 being aligned in a line in width-wise direction W of the housing 30 (hereinbelow, referred to as a first direction W). The electric connector 100 includes a rear holder 33 connected to the housing 30 through an elastically deformable hinge such that the rear holder 33 is rotatable relative to the housing 30. The electric connector 100 also includes a first engagement unit 34 for connecting the rear holder 33 and the housing 30 to each other after the rear, holder 33 is rotated onto the housing 30, and a second engagement unit 37 for preventing the rear holder 33 and the housing 30 from separating from each other after the rear holder 33 and the housing 30 are engaged to each other.

Figure 12:
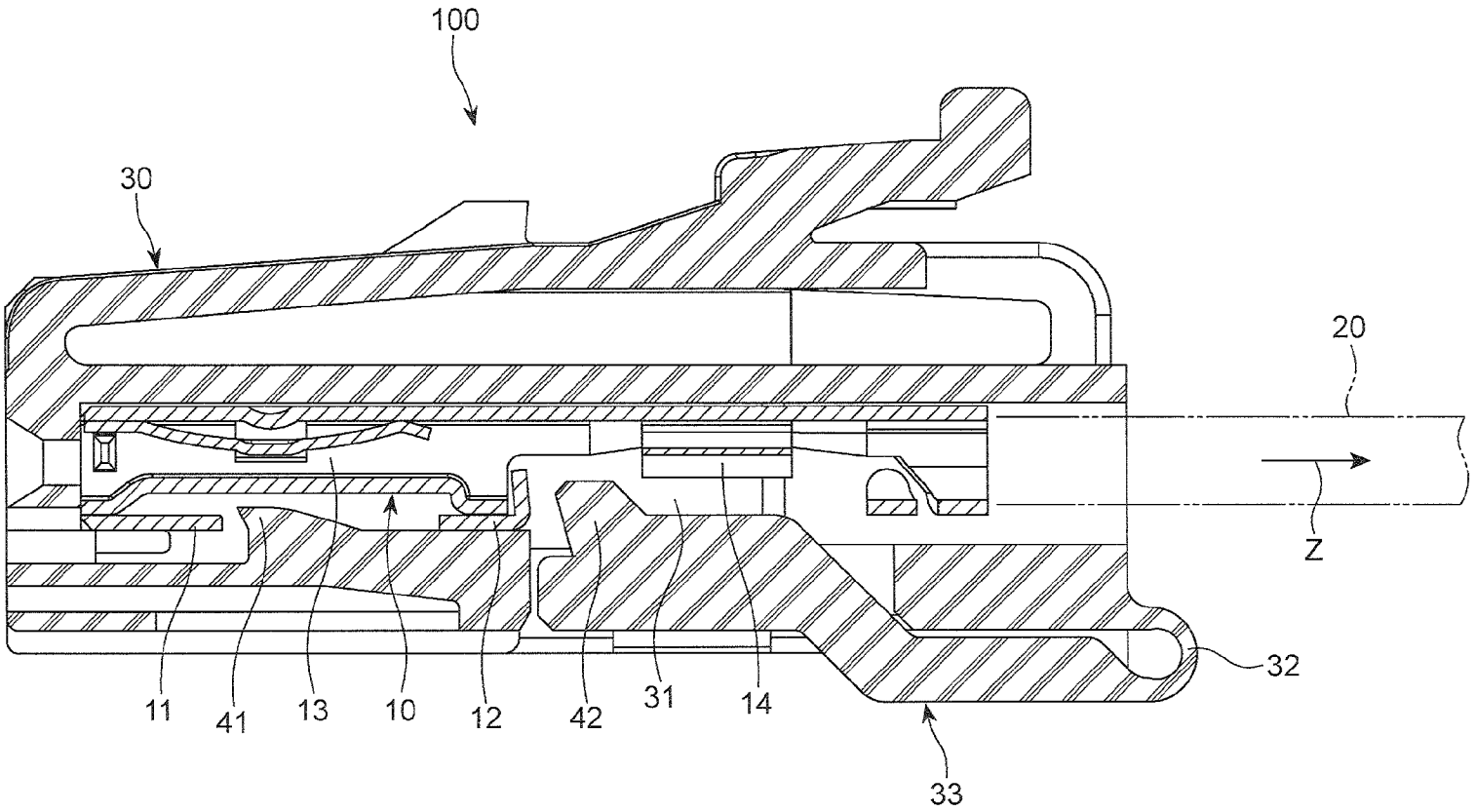
FIG. 12 is a cross-sectional view taken along the line H-H in FIG. 7.
Figure 13:
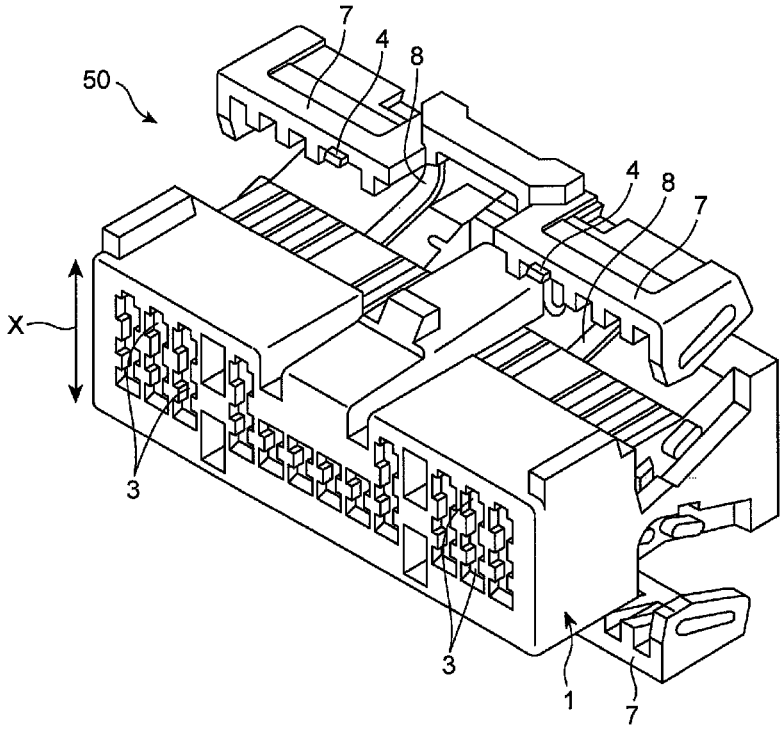
FIG. 13 PRIOR ART
FIG. 13 is a perspective view of a conventional electric connector.
Figure 14:
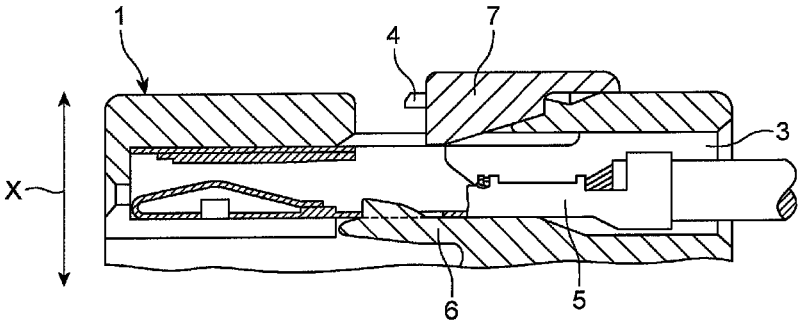
FIG. 14 PRIOR ART
FIG. 14 is a cross-sectional view of the electric connector in assembling illustrated in FIG. 13.
Figure 15A:
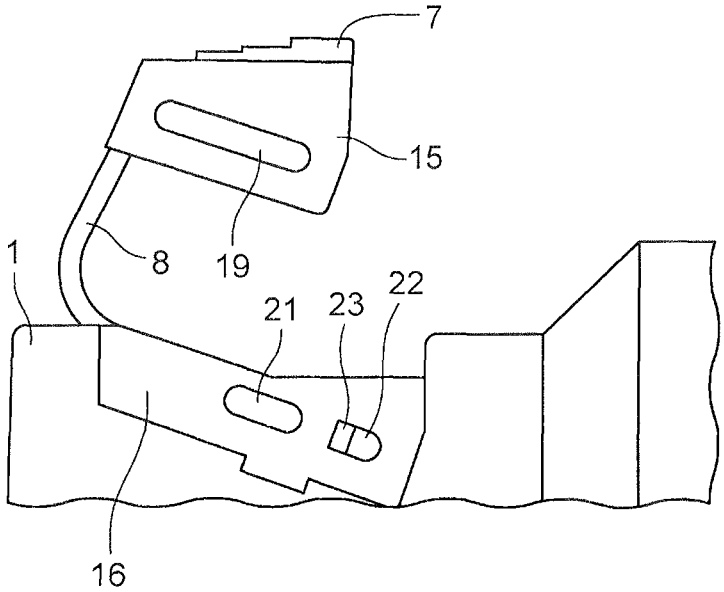
FIG. 15A PRIOR ART
FIG. 15A is a side view of the electric connector in assembling illustrated in FIG. 13.
Figure 15B:
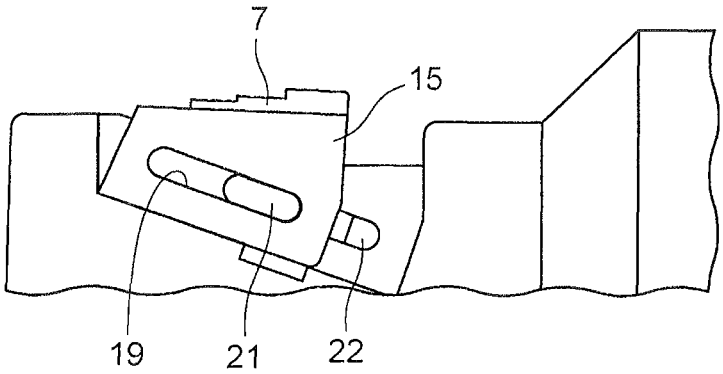
FIG. 15B PRIOR ART
FIG. 15B is a side view of the electric connector in assembling illustrated in FIG. 13.
Figure 15C:
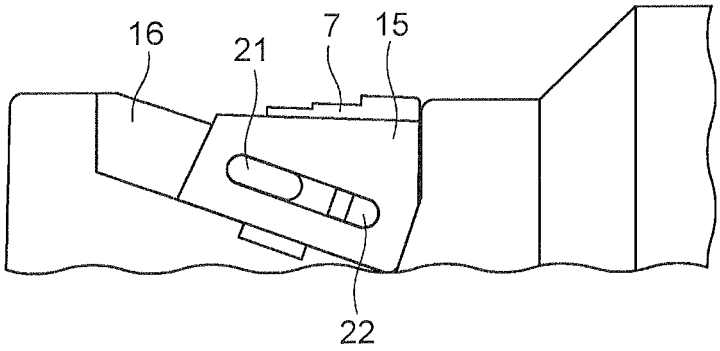
FIG. 15C PRIOR ART
FIG. 15C is a side view of the electric connector in assembling illustrated in FIG. 13.

As illustrated in FIGS. 1 and 12, the terminal 10 includes a hollow contact section 13 having a rectangular cross-section and being open at a front thereof such that a second terminal can be inserted thereinto, and a cable-fixing section 14 to which a cable 20 is fixed. The cable-fixing section 14 is continuous to a proximal end of the contact section 13.

The contact section 13 is formed at a distal end thereof with a first engagement wall 11, and further, at a proximal end thereof with a second engagement wall 12.

The terminal 10 can be fabricated by pressing and/or bending an electrically conductive metal plate.

The first engagement unit 34 includes a pair of projections 36 formed as a part of the rear holder 33, and recesses 35 formed at the housing 30.

The second engagement unit 37 includes a first engagement section 39 formed as a part of the housing 30, and a second engagement section 38 formed as a part of the rear holder 33.

The first engagement units 34 are formed at opposite ends of the rear holder 33 and the housing 30 in the first direction W.

The second engagement unit 37 is formed at the rear holder 33 and the housing at a center in the first direction. W.

Figure 4:
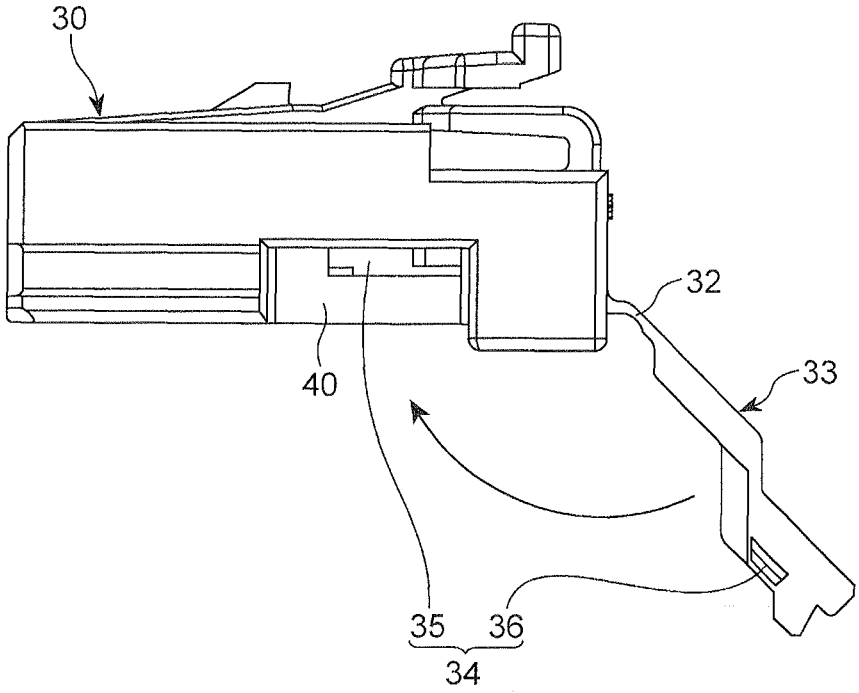
FIG. 4 is a side view of the electric connector, viewed in a direction of the arrow C shown in FIG. 1.
Figure 5:
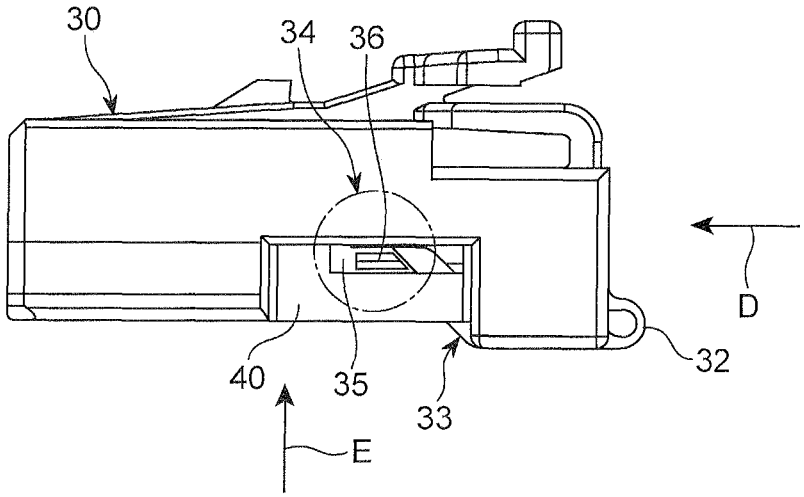
FIG. 5 is a side view of the electric connector wherein a rear holder and a housing are engaged to each other.
Figure 6:
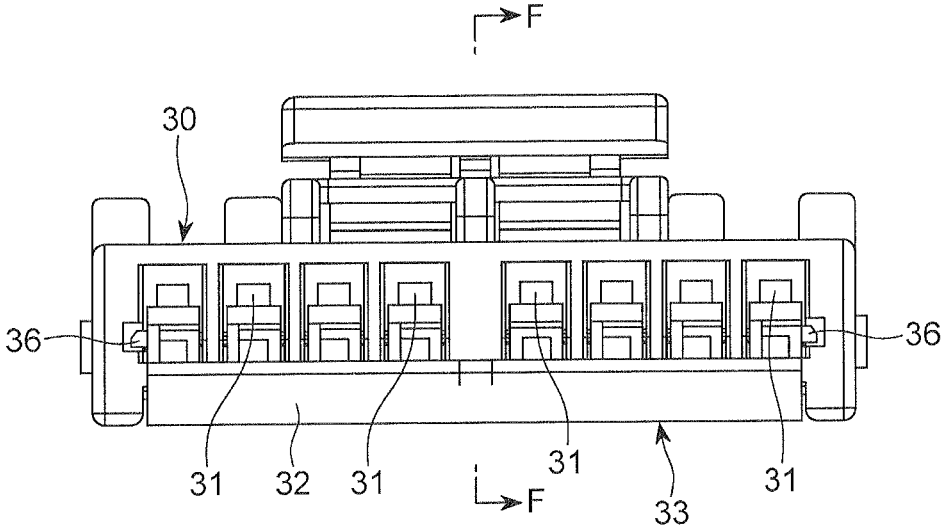
FIG. 6 is a rear view only of the housing of the electric connector, viewed in a direction of the arrow D shown in FIG. 5.
Figure 7:
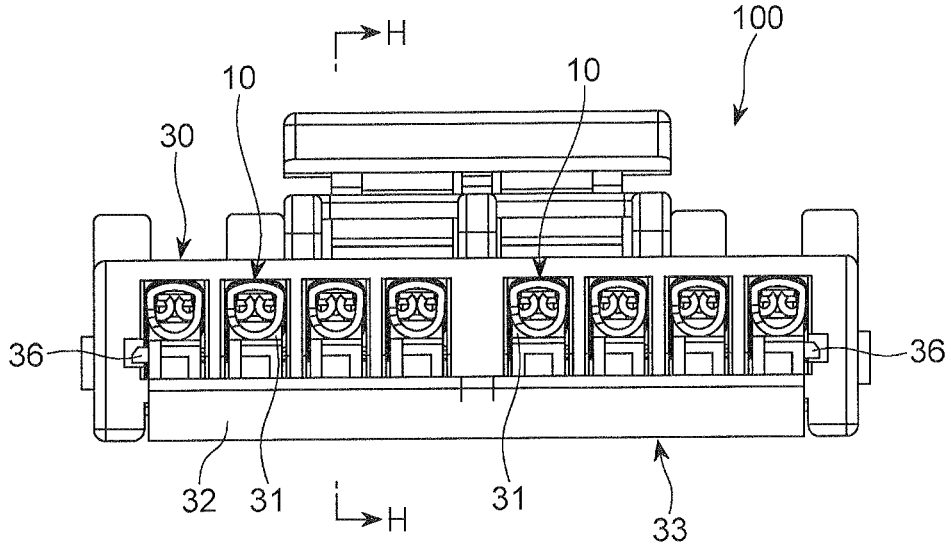
FIG. 7 is a rear view of the electric connector, viewed in a direction of the arrow D shown in FIG. 5.

As illustrated in FIGS. 4 and 5, when the rear holder 33 is rotated around the hinge 32 onto a lower surface of the housing 30, the projections 36 formed at the rear holder 33 are fit into the recesses 35 formed at the housing 30. Thus, the rear holder 33 is connected to the housing 30.

Each recess 35 is defined as an opening formed at a lower end of a wall 40 located at each of opposite ends of the housing 30 in the first direction W.

Each projection 36 projects outwardly in the first direction W from opposite ends of the rear holder 33 located in the first direction W.

When the rear holder 33 is rotated around the hinge 32 onto the housing 30, the projections 36 formed at the rear holder 33 at opposite ends in the first direction W are fit into the recesses 35 formed as openings formed at the lower ends of the walls 40, thus the rear holder 33 and the housing 30 are engaged to each other.

Figure 8:
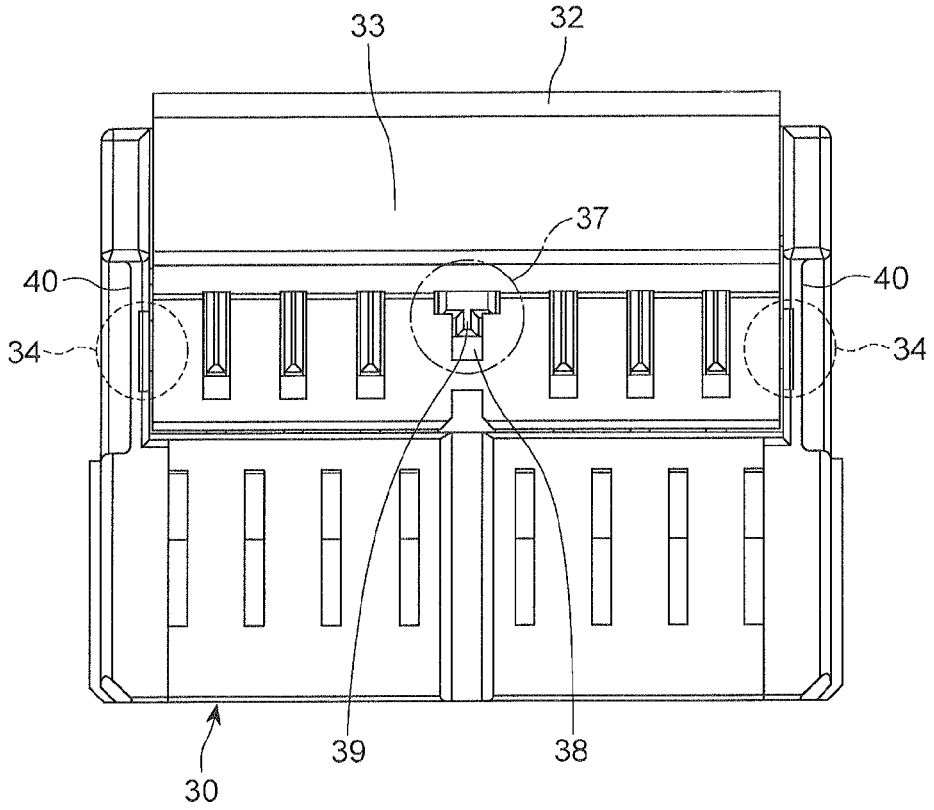
FIG. 8 is a bottom view of the electric connector, viewed in a direction of the arrow E shown in FIG. 5.
Figure 9:
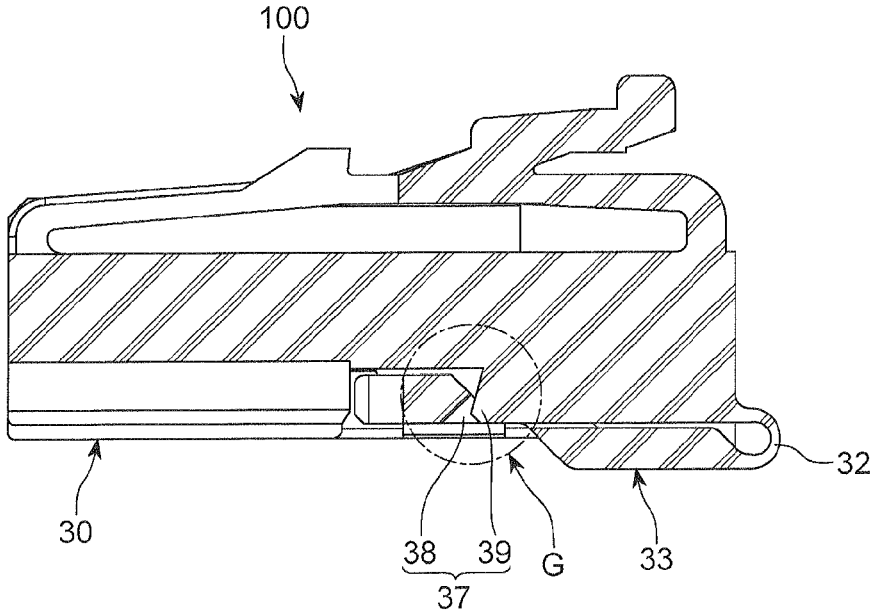
FIG. 9 is a cross-sectional view taken along the line F-F in FIG. 6.

As illustrated in FIGS. 2 and 8, the second engagement section 38 comprising a part of the second engagement unit 37 is situated at a center in the first direction W, and the first engagement section 39 comprising a part of the second engagement unit 37 is situated between the holes 31 located adjacent to each other, at a center in the first direction W.

Figure 10:
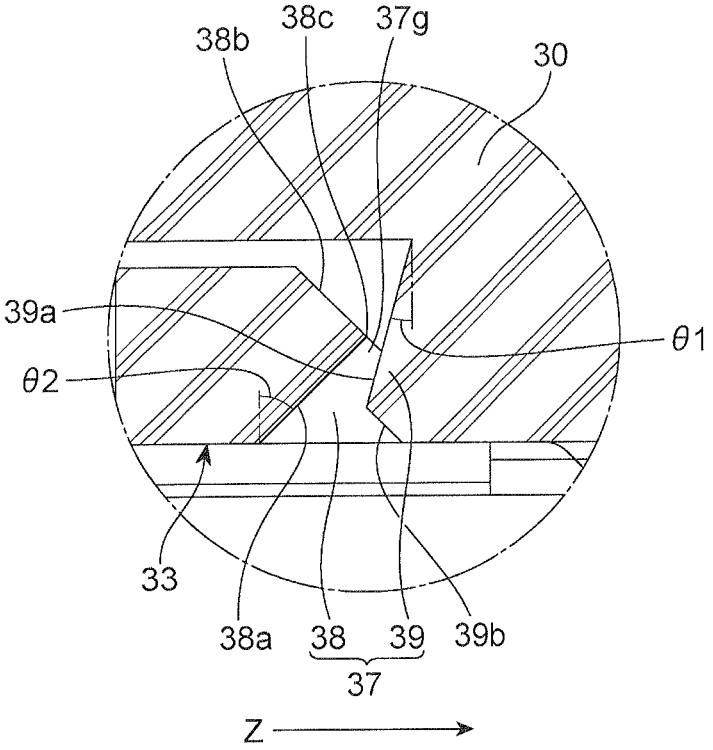
FIG. 10 is an enlarged view of a portion shown with the arrow G in FIG. 9.

FIG. 10 is a partially enlarged view of the first engagement unit 39 and the second engagement section 38.

The first engagement section 39 includes a first inclining surface 39*a* sloping upward or ascending in a direction Z that is opposite to a direction in which the terminal 10 is inserted into each of the holes 31. The first engagement section 39 includes a second inclining surface 39*b* sloping downward or descending in the direction Z. The first inclining surface 39*a* is continuous at a lower end thereof with the second inclining surface 39*b* at an upper end thereof, and thus, the first inclining surface 39*a* and the second inclining surface 39*b* defining a triangle projecting in a direction in which the terminal 10 is inserted into each of the holes 31.

The second engagement section 38 includes a third inclining surface 38*a* sloping upward or ascending in the direction Z, and a fourth inclining surface 38*b* sloping downward or descending in the direction Z.

Similarly to the first and second inclining surfaces 39*a* and 39*b*, the third inclining surface 38*a* is continuous at an upper end thereof with the fourth inclining surface 38*b* at a lower end thereof, and thus, the third inclining surface 38*a* and the fourth inclining surface 38*b* defining a triangle projecting in the direction Z. A point at which the third and fourth inclining surfaces 38*a* and 38*b* make contact with each other defines a tip end 38*c* of the second engagement section 38.

The tip end 38*c* of the second engagement section 38 is located horizontally within a length of the first inclining surface 39*a* of the first engagement section 39 when the rear holder 33 is engaged with the housing 30. As mentioned later, the tip end 38*c* makes point-contact or line-contact with the first inclining surface 39*a* when a tensile force acts on the rear holder 33 in the direction Z.

As illustrated in FIG. 10, the first inclining surface 39*a* forms an angle θ1 relative to a vertical direction, and the third inclining surface 38*a* forms an angle θ2 relative to a vertical direction. The angle θ2 is set greater than the angle θ1.

$$\theta 2 > \theta 1$$

When the rear holder 33 is rotated around the hinge 32 onto the lower surface of the housing 30, the first inclining surface 39*a* of the first engagement section 39 and the third inclining surface 38*a* of the second engagement section 38 are kept facing each other with a gap 37*g* (see FIG. 10) created between the inclining surfaces 39*a* and 38*a* and between the two holes 31 located adjacent to each other, at a center in the first direction W.

In such a condition that the terminals 10 are inserted into the holes 31, the cable-fixing sections 14 of the terminals 10 are aligned in a line.

As illustrated in FIG. 2, the first engagement section 39 of the second engagement unit 37 is located in an area in which the cable-fixing sections 14 of the terminals 10 are aligned in a line. Accordingly, when the rear holder 33 is rotated around the hinge 32 onto the housing 30, the second engagement unit 37 is located in the above-mentioned area.

The electric connector 100 in accordance with the current embodiment is used as follows.

As mentioned above, after the terminals 10 are inserted into the holes 31 of the housing 30, the rear holder 33 is rotated around the hinge 32, as illustrated in FIG. 4. Thus, the rear holder 33 is engaged with the housing 30, as illustrated in FIG. 5. In this condition, the recesses 35 and the projections 36 both defining the first engagement unit 34 are engaged to each other, and further, the first engagement section 39 and the second engagement section 38 both defining the second engagement unit 37 are brought into a condition to be fittable to each other.

As illustrated in FIG. 12, a first engagement portion 41 formed in each of the holes 31 of the housing 30 faces the first engagement wall 11 of the terminal 10, and a second engagement portion 42 formed at the rear holder 33 faces the second engagement wall 12 of the terminal 10. If the cable 20 is pulled in the direction Z, and accordingly, a force acts on the terminal 10 in the direction Z, the terminal 10 slightly moves in the direction Z. However, the first and second engagement walls 11 and 12 of the terminal 10 make abutment with the first and second engagement portions 41 and 42, respectively, thereby preventing the terminal 10 from being released from the housing 30.

In the above-mentioned condition, if a greater force acts on the terminal in the direction Z, the second engagement wall 12 of the terminal 10 compresses the second engagement portion 42 of the rear holder 33, and thus, the rear holder 33 is forced to deform and expand outwardly of the housing 30. However, the first engagement section 39 and the second engagement section 38 both defining the second engagement unit 37, which are in such a condition as illustrated in FIG. 10, are brought to make abutment with each other, thereby preventing the housing 30 from being deformed. Accordingly, it is possible to prevent the rear holder 33 from being released from the housing 30.

Hereinbelow is explained the function of the first and second engagement sections 39 and 38 with reference to FIGS. 10 and 11. The first and second engagement sections 39 and 38 have the function of preventing the rear holder 33 from being released from the housing 30.

If the cable 20 is pulled in the direction Z, that is, if a tensile force F1 (see FIG. 11) acts on the cable 20, the tensile force F1 is transferred to the rear holder 33 through the terminal 10, and accordingly, the rear holder 33 is forced to slightly move in the direction Z. As a result, as illustrated in FIG. 11, the tip end 38*c* defined by the third and fourth inclining surfaces 38*a* and 38*b* moves in the direction Z, and then, makes contact with the first inclining surface 39*a* of the first engagement section 39.

The tensile force F1 can be divided into a first component force F2 exerted in parallel with the first inclining surface 39*a* and a second component force F3 exerted perpendicularly to the first inclining surface 39*a*.

Figure 11:
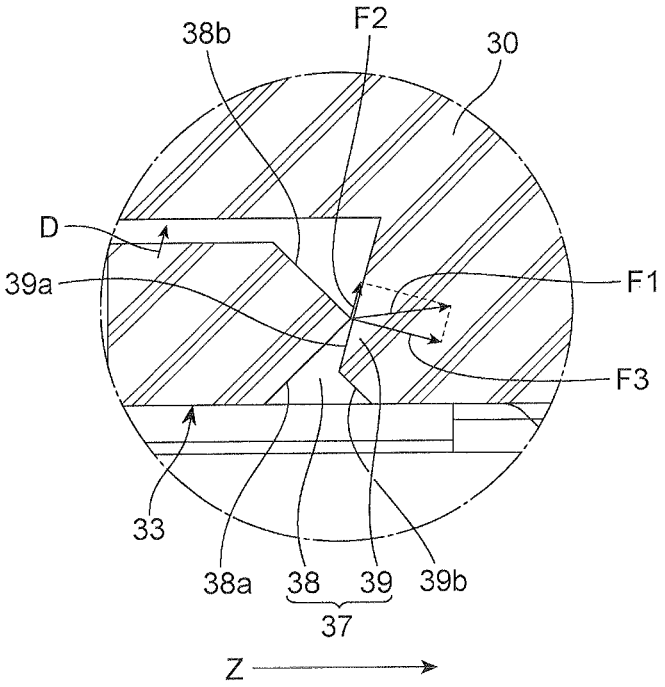
FIG. 11 is an enlarged view of the portion shown with the arrow G in FIG. 9.

Since the first component force F2 acts on the rear holder 33, the rear holder 33 is forced to move in a direction indicated with an arrow D (a direction in parallel with the first inclining surface 39*a*, or obliquely and upwardly in FIG. 11) relative to the housing 30.

An elastic force caused by the hinge 32 exerts a force on the rear holder 33. This force, which directs in a direction opposite to a direction of the first component force F2, causes the rear holder 33 to be released from the housing 30.

However, the first component force F2 acts as a counter force against the force. That is, the first component force F2 works as a force for keeping the rear holder 33 and the housing 30 engaged to each other. Thus, the first component force F2 makes it possible to prevent the rear holder 33 and the housing 30 from being released from each other.

As mentioned above, even if the tensile force F1 acts on the cable 20 in the direction Z, the first component force F2 derived from the tensile force F1 works as a force to prevent the rear holder 33 and the housing 30 from being released from each other, by virtue of the interaction made between the first inclining surface 39*a* of the first engagement section 39 and the tip end 38*c* making contact with the first inclining surface 39*a*. Thus, even if a force acts on the rear holder 33 and the housing 30 to separate them from each other, the interaction between the first and second engagement sections 39 and 38 makes it possible to prevent the rear holder 33 from being released from the housing 30.

In the current embodiment, the first inclining surface 39*a* is designed to slope upward or ascend in the direction Z such that the component force F2 is generated on the rear holder 33 when a force by which the rear holder 33 is to be released from the housing 33 acts on the rear holder 33, that is, a force exerted in the direction Z. Thus, the component force F2 acts on the rear holder 33 to thereby keep the rear holder 33 and the housing 30 engaged with each other, and hence, it is possible to prevent the rear holder 33 and the housing 30 from being released from each other.

The electric connector 100 in accordance with the current embodiment provides the following advantages.

When the rear holder 33 is rotated around the hinge 32 onto the housing 30 after the terminals 10 are inserted into the holes 31 of the housing 30, the recesses 35 and the projections 36 defining the first engagement unit 34 are fit into each other, and accordingly, the rear holder 33 and the housing 30 are engaged to each other. Thus, the electric connector 100 in accordance with the current embodiment can be readily assembled.

Furthermore, the rear holder 33 and the housing 30 are engaged to each other through the first engagement unit 34 arranged at opposite ends of the rear holder 33 and the housing 30 in the first direction W, and in addition, the second engagement unit 37 arranged between the two holes 31 located adjacent to each other prevents the rear holder 33 from releasing from the housing 30 even if the rear holder 33 is deformed. Thus, it ensures to effectively prevent the rear holder 33 from being released from the housing 30.

Furthermore, since the first and second engagement units 34 and 37 are arranged both in the direction W, it is possible to avoid that an area in which the holes 31 are formed and the first and second engagement units 34 and 37 are situated in a multi-layered condition, that is, to avoid increasing the size of the electric connector 100 in the direction X (see FIG. 1). Thus, it is not prevented to design the electric connector 100 to be low in height.

Since the second engagement unit 37 is arranged at a center in the direction W, it is possible to prevent deformation of a central area of the rear holder 33, which is readily deformed.

Since an electric connector is recently requested to be low in height, the housing 30 and/or the rear holder 33 are designed to have a reduced thickness, resulting in deterioration in a physical strength of the housing 30 and/or the rear holder 33. Accordingly, when a second terminal (not illustrated) is inserted into the contact section 13 of the terminal 10, a spring of the terminal 10 may be elastically deformed to thereby exert a resultant stress on the contact section 13 of the terminal 10. The stress is transferred to the housing 30 with the result of elastic deformation of the housing 30. Consequently, the rear holder 33 is released from the housing 30 at worst.

However, the second engagement unit 37 is arranged in an area in which the cable-fixing sections 14 of the terminals 10 inserted into the holes 31 are aligned, that is, an area remote from an area in which the contact sections 13 are aligned. Thus, the electric connector 100 in accordance with the present embodiment can avoid the above-mentioned problem.

In addition, the second engagement unit 37 is designed to be simple in structure, because the second engagement unit 37 is comprised of the first engagement section 39 formed as a part of the housing 30 and the second engagement section 38 formed as a part of the rear holder 33. It is not necessary for the electric connector 100 to include additional parts, and thus, it is possible to avoid a process of fabricating the electric connector 100 from being complex.

In the electric connector 100 in accordance with the current embodiment, the angle θ1 at which the first inclining surface 39*a* inclines relative to a vertical direction is in the range of 10 degrees to 45 degrees both inclusive.

The greater the angle θ1 is, the greater the component force F2 is. However, the rear holder may be difficult to be engaged with the housing 30. If the angle θ1 is set smaller, the rear holder 33 can be more readily engaged to the housing 30, but the component force F2 becomes smaller. Thus, the angle θ1 is determined in view of a balance between an intensity of the component force F2 (that is, smallness in possibility of the rear holder 33 being released from the housing 30) and readiness in engagement of the rear holder 33 with the housing 30.

INDUSTRIAL APPLICABILITY

The electric connector in accordance with the present invention can be employed broadly in various industrial fields such as an electronic/electric device industry and an automobile industry, as a device for electrically connecting a circuit board and a wire harness to each other.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-103561 filed on May 19, 2014 including specification, claims, drawings and summary is incorporated herein by reference in its entirety.

What is claimed is:

1. An electric connector including:

a housing formed with a plurality of holes into each of which a terminal is inserted, said holes being aligned in a line in a first direction;

a rear holder connected to said housing through a hinge such that said rear holder is rotatable relative to said housing;

a first engagement unit for connecting said rear holder and said housing to each other said first engagement unit being arranged at at least one of opposite ends in said first direction; and a second engagement unit for avoiding said rear holder and said housing from separating from each other after said rear holder and said housing were connected to each other, said second engagement unit being situated between said holes located adjacent to each other, said second engagement unit including:

a first engagement section formed at said housing; and a second engagement section formed at said rear holder, said first engagement section including a first inclining surface sloping upward in a second direction opposite to a direction in which said terminal is inserted into each of said holes, said second engagement section including a tip end making point-contact or line-contact with said first inclining surface when a tensile force acts on said rear holder in said second direction.

2. The electric connector as set forth in claim 1, wherein said first engagement section further includes a second inclining surface sloping downward in said second direction, said first inclining surface and said second inclining surface being continuous with each other.

3. The electric connector as set forth in claim 1, wherein said second engagement section includes:

a third inclining surface sloping upward in said second direction; and a fourth inclining surface sloping downward in said second direction, said tip end being defined as a point at which said third and fourth inclining surfaces make contact with each other.

4. The electric connector as set forth in claim 3, wherein an angle at which said third inclining surface inclines relative to a vertical direction is greater than an angle at which said first inclining surface inclines relative to a vertical direction.

5. The electric connector as set forth in claim 1, wherein an angle at which said first inclining surface inclines relative to a vertical direction is in the range of 10 degrees to 45 degrees both inclusive.

6. The electric connector as set forth in claim 1, wherein said second engagement unit is formed at said housing at a center in said first direction.

7. The electric connector as set forth in claim 1, wherein said terminal includes a hollow contact section into which a second terminal can be inserted, and a cable-fixing section to which a cable is fixed, said cable-fixing section being continuous to a proximal end of said contact section, said second engagement unit being formed in an area in which cable-fixing sections of said terminals inserted into said holes are situated.

* * * * *